US009056745B2

(12) United States Patent
Harada et al.

(10) Patent No.: US 9,056,745 B2
(45) Date of Patent: Jun. 16, 2015

(54) IMAGE FORMING APPARATUS

(71) Applicant: CANON KABUSHIKI KAISHA, Tokyo (JP)

(72) Inventors: Yuko Harada, Yokohama (JP); Daisuke Aoki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/762,788

(22) Filed: Feb. 8, 2013

(65) Prior Publication Data

US 2013/0221612 A1 Aug. 29, 2013

(30) Foreign Application Priority Data

Feb. 23, 2012 (JP) ..... 2012-037543

(51) Int. Cl.

| | |
|---|---|
| ***B65H 5/00*** | (2006.01) |
| ***B65H 85/00*** | (2006.01) |
| ***B65H 5/06*** | (2006.01) |
| ***B65H 1/26*** | (2006.01) |

(52) U.S. Cl.

CPC ..... *B65H 85/00* (2013.01); *B65H 5/062* (2013.01); *B65H 2405/11425* (2013.01); *B65H 2405/1144* (2013.01); *B65H 2511/12* (2013.01); *B65H 2511/00* (2013.01); *B65H 2511/10* (2013.01); *B65H 2511/40* (2013.01); *B65H 1/266* (2013.01); *B65H 2402/32* (2013.01); *B65H 2404/144* (2013.01); *B65H 2404/611* (2013.01); *B65H 2405/114* (2013.01); *B65H 2801/09* (2013.01)

(58) Field of Classification Search

CPC .... B65H 1/04; B65H 85/00; B65H 2405/114; B65H 2405/11425; B65H 2405/1144; B65H 2511/00; B65H 2511/10; B65H 2511/12; B65H 2511/40; B65H 2701/1131; B65H 2405/1122; B65H 2405/1134

USPC ..... 271/3.18, 264, 171

See application file for complete search history.

(56) References Cited

U.S. PATENT DOCUMENTS

| | | | | |
|---|---|---|---|---|
| 6,980,766 | B2 * | 12/2005 | Ito | 399/395 |
| 6,994,341 | B2 | 2/2006 | Aoki et al. | |
| 8,508,819 | B2 | 8/2013 | Asada et al. | |
| 2011/0188097 | A1 * | 8/2011 | Asada et al. | 358/498 |
| 2013/0321548 | A1 | 12/2013 | Asada | |

FOREIGN PATENT DOCUMENTS

| | | | |
|---|---|---|---|
| JP | 2006-069732 | A | 3/2006 |
| JP | 2009083996 | A | 4/2009 |
| JP | 2011157155 | A | 8/2011 |
| JP | 4868164 | B2 | 2/2012 |

* cited by examiner

*Primary Examiner* — Prasad Gokhale

(74) *Attorney, Agent, or Firm* — Fitzpatrick, Cella, Harper & Scinto

(57) ABSTRACT

A supporting portion is provided to project from an upper surface of a side regulating member which is provided in a sheet feeding cassette which is detachably attached to a color laser beam printer body, and which regulates a position of a sheet in a width direction orthogonal to a sheet feeding direction, and this supporting portion regulates downward deformation of a conveyance guiding member which is positioned above the sheet feeding cassette and which forms a sheet conveying path R which guides the sheet.

14 Claims, 6 Drawing Sheets

IMAGE FORMING APPARATUS

BACKGROUND OF THE INVENTION

1. Field of the Invention

The present invention relates to an image forming apparatus and, more particularly, relates to an image forming apparatus in which a sheet conveying path on which a sheet passes is provided above a sheet storage portion attached to an apparatus body.

2. Description of the Related Art

Conventionally, there are image forming apparatuses which form images on a sheet using an electrophotograhic image forming system, and these image forming apparatuses include, for example, copying machines, laser beam printers, LED printers, facsimile apparatuses and word processors. Generally, in such a conventional image forming apparatus, standard size sheets of a high use frequency are stacked in a sheet feeding cassette in which a predetermined number of sheets can be stacked and are fed, and special sheets other than standard size sheets of a low use frequency such as cardboards and standard size sheets such as elongated sheets are manually fed.

Further, to feed a cardboard and a special sheet, one or a plurality of sheets is manually set in a manual feed tray, and is fed toward an image forming portion by a guiding portion of a sheet conveying path. Meanwhile, in such an image forming apparatus, the guiding portion of the sheet conveying path is arranged above the sheet feeding cassette.

Further, some conventional image forming apparatuses have re-feeding/conveying portion which feeds again a sheet for forming an image on a back surface after an image is formed on one surface, to an image forming portion. Furthermore, also in the re-feeding/conveying portion of such an image forming apparatus, a guiding portion which guides to the image forming portion a sheet on one surface of which an image is formed is arranged above the sheet feeding cassette (see Japanese Patent Laid-Open No. 2006-69732).

Incidentally, in such a conventional image forming apparatus, a gap is provided between a guiding portion and a sheet feeding cassette such that, when the sheet feeding cassette is attached and detached to and from the image forming apparatus body, the guiding portion of the sheet conveying path and the sheet feeding cassette do not interfere with each other.

Meanwhile, a plurality of conveying rollers which forms pairs of conveying rollers is attached to the guiding portion, and therefore a reaction force is applied from the conveying rollers when a sheet is conveyed. Further, when the reaction force of the conveying rollers is applied in this way, the gap is formed between the conveying rollers and the sheet feeding cassette, and therefore there is a concern that the conveyance guiding portion deflects downward and deforms. Furthermore, even when, for example, an image forming apparatus is left in high-temperature environment after product shipping, a gap is formed between a sheet feeding cassette and a conveyance guiding portion, and therefore there is a concern that the conveyance guiding portion deflects downward and deforms.

Meanwhile, when the feeding guiding portion deforms downward in this way, for example, a sheet nipping pressure of pairs of conveying rollers decreases and a conveying force decreases. In addition, to prevent deformation of the conveyance guiding portion, there is a countermeasure of sufficiently securing the thickness of the conveyance guiding portion and improving rigidity of the conveyance guiding portion or reinforcing the conveyance guiding portion using, for example, a sheet metal.

However, when the thickness of the conveyance guiding portion is sufficiently secured or the conveyance guiding portion is reinforced using, for example, a metal sheet, the image forming apparatus not only becomes heavy and large but also causes an increase in cost. That is, the above countermeasure cannot sufficiently meet requests of reducing cost, reducing the weight and reducing the size of the image forming apparatus.

The present invention is made in light of this situation, and it is desirable to provide an image forming apparatus which is low-cost, small and light, and which can stably convey a sheet.

SUMMARY OF THE INVENTION

The present invention has in an image forming apparatus a sheet storage portion which is detachably attached to an apparatus body, a guiding member which is positioned above the sheet storage portion attached to the apparatus body and which forms a sheet conveying path which guides a sheet, and a regulating portion which is provided in the sheet storage portion, and which regulates a position of the sheet in a width direction orthogonal to a sheet feeding direction, and abuts on the guiding member and regulates downward deformation of the guiding member.

According to the present invention, there is provided an image forming apparatus including a regulating portion which regulates a position of a sheet in a width direction and regulates downward deformation of a guiding member which forms a sheet conveying path on which the sheet passes. Consequently, a low-cost, small and light image forming apparatus can stably convey the sheet.

Further features of the present invention will become apparent from the following description of exemplary embodiments with reference to the attached drawings.

DESCRIPTION OF THE EMBODIMENTS

Figure 1:
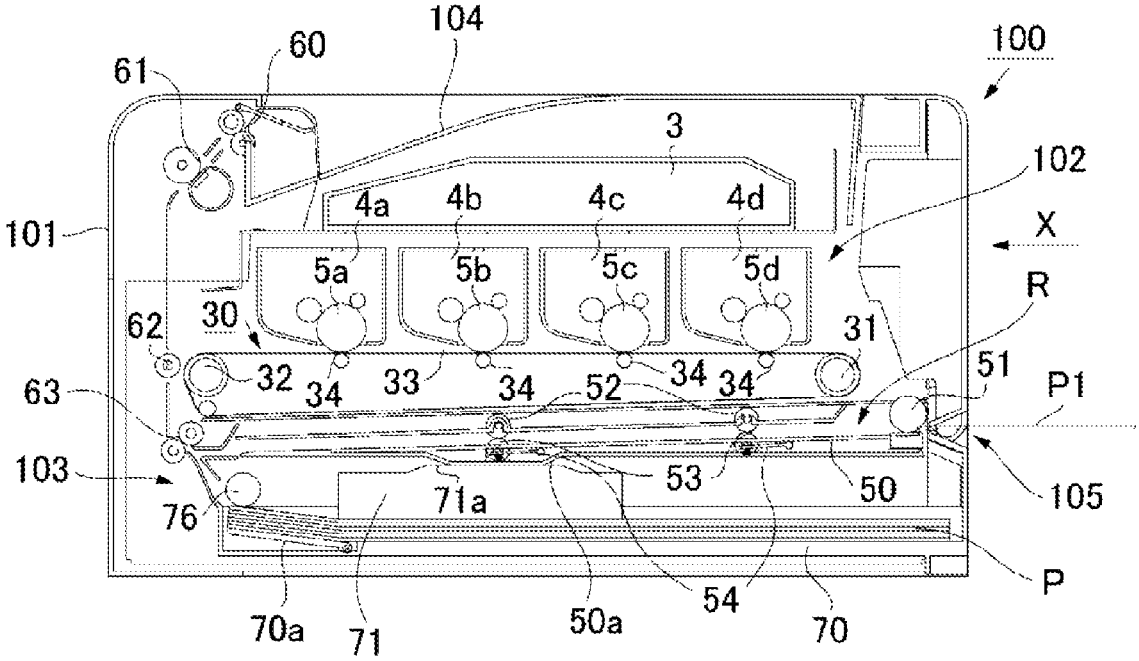
FIG. 1 is a view illustrating a schematic configuration of a color laser beam printer which is an example of an image forming apparatus according to a first embodiment of the present invention.

An embodiment for implementing the present invention will be described in detail below with reference to the drawings. FIG. 1 is a view illustrating a schematic configuration of a color laser beam printer which is an example of an image forming apparatus according to a first embodiment of the present invention, and FIG. 1 illustrates a color laser beam printer 100 and a color laser beam printer body (referred to as a "printer body") 101. This color laser beam printer 100 includes, for example, an image forming portion 102 which forms images and a sheet feeding portion 103.

The image forming portion 102 includes process cartridges 4 (4*a* to 4*d*) which are four image forming units of four colors of magenta (M), yellow (Y), cyanogen (C) and black (Bk) provided in parallel. Further, the image forming portion 102 includes, for example, a scanner portion 3 and an intermediate transfer belt 33 which is an endless intermediate transfer member. In addition, each process cartridge 4 includes a photosensitive drum 5 (5*a* to 5*d*) which is arranged to rotate counterclockwise, and an electrostatic latent image is formed on a surface of this photosensitive drum 5 by exposure by the scanner portion 3.

Meanwhile, the intermediate transfer belt 33 contacts each photosensitive drum 5 of the process cartridge 4 linearly arranged above, and is stretched by a driving roller 31 and a counter roller 32 and rotates in a clockwise direction upon formation of a color image. Further, primary transfer rollers 34 are in contact with this intermediate transfer belt 33 upon image formation, and, when the intermediate transfer belt 33 rotates, these primary transfer rollers 34 sequentially transfer each color toner image formed on the photosensitive drum 5, on the intermediate transfer belt 33. Furthermore, each color toner image transferred on this intermediate transfer belt 33 is transferred to a sheet when a secondary transferring portion formed by a secondary transfer roller 62 and the counter roller 32 nips and conveys the sheet.

The sheet feeding portion 103 includes a sheet feeding cassette 70 which is a sheet storage portion which is detachably attached to a printer body 101 which is an image forming apparatus body, and a sheet feeding roller 76 which feeds a sheet P stored in the sheet feeding cassette 70. In addition, this sheet feeding cassette 70 is provided with a sheet supporting plate 70*a* which supports the stored sheet P and presses the sheet P against the sheet feeding roller 76. Further, this sheet feeding cassette 70 is provided with side regulating members 71 which are regulating members which regulate the position of the stored sheet P in a width direction orthogonal to a sheet feeding direction and which can move in the width direction.

In addition, FIG. 1 illustrates a registration roller 63 and an opening portion 105 which is formed in one side surface of the printer body 101 such that a sheet can be manually fed, and a manually fed sheet P1 is inserted in this opening portion 105 to manually feed the sheet. Further, a conveyance guiding member 50 is positioned above the sheet feeding cassette 70, and forms a sheet conveying path R which guides the sheet P1 inserted in the opening portion 105 to the registration roller 63.

Next, an image forming operation of the color laser beam printer 100 formed in this way will be described. To form a color image on a sheet, the photosensitive drum 5 is first electrically charged, and then the photosensitive drum 5 is exposed by the scanner portion 3 based on an image signal of each color component transmitted from a controller which is not illustrated. By this means, an electrostatic latent image is formed on the surface of the photosensitive drum.

Next, this electrostatic latent image is developed by each color toner of magenta, yellow, cyanogen and black to form a toner image on the photosensitive drum. Subsequently, when the toner image comes to a transfer site at which the photosensitive drum 5 and the intermediate transfer belt 33 abut on each other following rotation of the photosensitive drum 5, the primary transfer rollers 34 apply primary transfer biases. By this means, the toner image on the photosensitive drum is primarily transferred to the intermediate transfer belt 33 which is rotating in the clockwise direction. In addition, this toner image is transferred on the intermediate transfer belt sequentially in order of magenta, yellow, cyanogen and black following rotation of the intermediate transfer belt 33, and thereby a color toner image is formed on the intermediate transfer belt.

Meanwhile, the sheet P is fed from the sheet feeding cassette 70 by the sheet feeding roller 76 according to a predetermined sequence control timing in parallel to this color toner image forming operation. Further, the fed sheet P is conveyed to the registration roller 63 which is stopping, and skewing feeding of the sheet P is corrected by this registration roller 63. Then, the registration roller 63 starts rotating at a timing when the color toner image formed on the intermediate transfer belt and the front end of the sheet P align.

By this means, the sheet P which stops once is conveyed to the secondary transferring portion formed by the secondary transfer roller 62 and the counter roller 32, and a color toner image is transferred to the sheet P by a transfer bias applied to the secondary transfer roller 62. Further, after the color toner image is transferred, the sheet P is conveyed to a fixing portion 61 from the secondary transferring portion, the sheet P is heated and pressured by this fixing portion 61 and a color toner image is fixed on the sheet. Furthermore, the sheet P on which the color toner image is fixed is then discharged to a discharge tray 104 provided on an upper surface of the printer body by a pair of discharge rollers 60.

Meanwhile, to manually feed a sheet, the manually fed sheet P1 is inserted in the opening portion 105 provided on one side surface of the printer body 101. By this means, the sheet P1 passes the sheet conveying path R while being guided by the conveyance guiding member 50 and reaches the registration roller 63, and then skew feeding of the sheet P1 is corrected by the registration roller 63 similar to the sheet P stacked in the sheet feeding cassette 70. Subsequently, similar to the sheet P stacked in the sheet feeding cassette 70, a color toner image is transferred and fixed on the sheet P1 and the sheet P1 is discharged to the discharge tray 104.

Figure 2A:
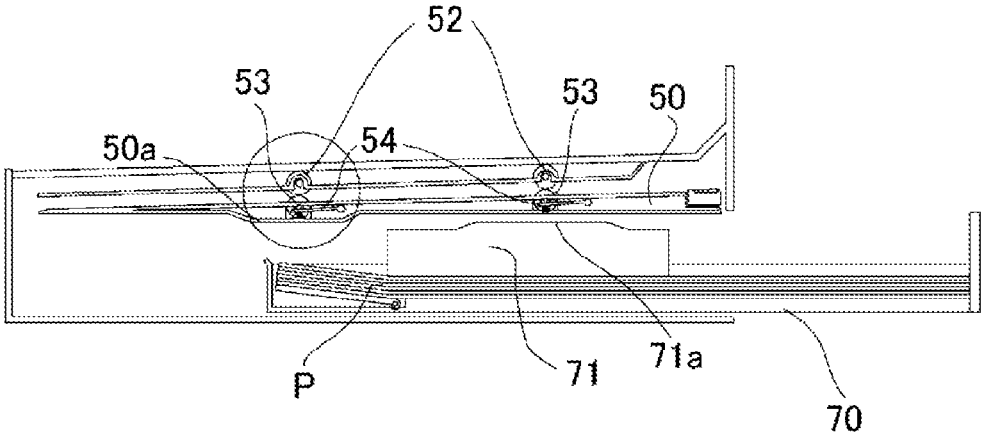
FIGS. 2A to 2C are first views describing a configuration of a conveyance guiding member and a sheet feeding cassette provided in the color laser beam printer.
Figure 2B:
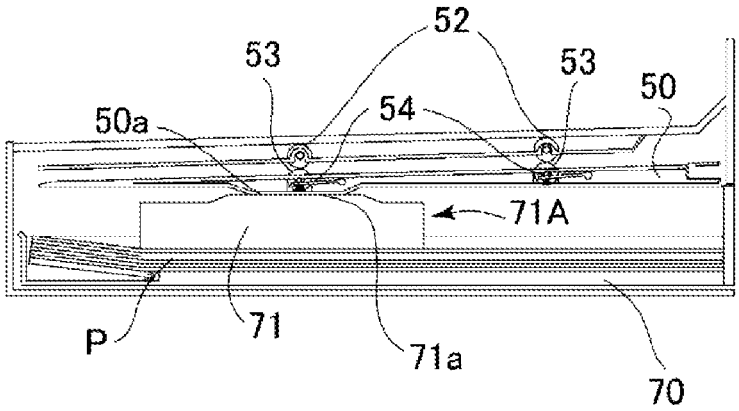
Figure 2C:
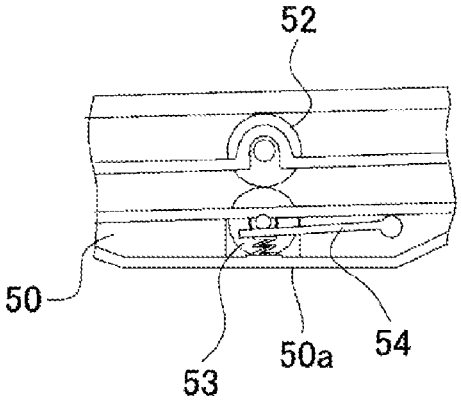

Meanwhile, as illustrated FIGS. 2A and 2B, for example, two conveying rollers 53 are rotatably provided to the conveyance guiding member 50. Further, as illustrated in the printer body 101 or FIG. 2C, these conveying rollers 53 are pressed by pressing members 54 which are provided to the conveyance guiding member 50, against the drive rollers 52 which are rotatably supported by the printer body 101. The drive roller 52 is driven by a motor.

Furthermore, as illustrated in FIGS. 2A and 2B, an abutting portion 50*a* which is a convex portion and which abuts on upper ends of the side regulating members 71 is provided on the bottom surface of the conveyance guiding member 50, and supporting portions 71*a* are provided to project from the upper ends of the side regulating members 71. These supporting portion 71*a* abut on the abutting portion 50*a* of the conveyance guiding member 50 and support the conveyance guiding member 50 from below when the sheet feeding cassette 70 is attached to the printer body 101.

Further, when the sheet feeding cassette 70 is attached to the printer body 101 in this way, it is possible to prevent deformation of the conveyance guiding member 50 by supporting the conveyance guiding member 50 by means of the side regulating members 71. That is, in the present embodiment, the side regulating members 71 and the supporting portions 71*a* of the side regulating members 71 form a regulating portion 71A which regulates the position of the sheet in the width direction, and abuts on the conveyance guiding member 50 and regulates downward deformation of the conveyance guiding member 50.

Figure 3:
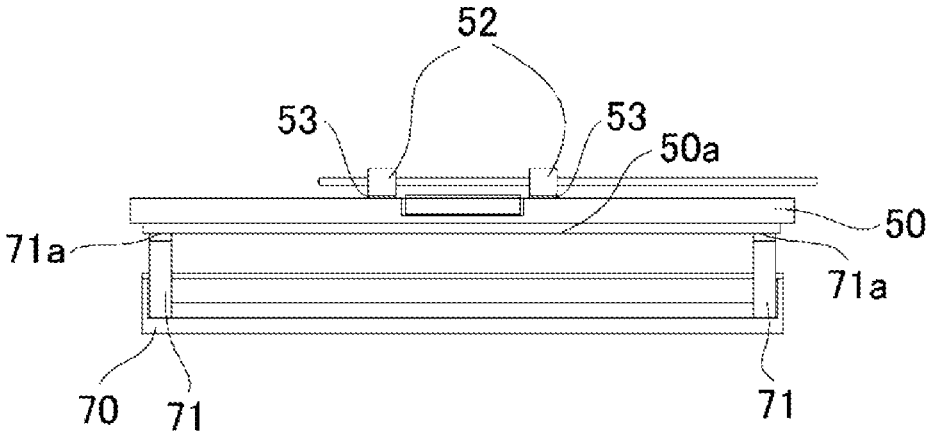
FIG. 3 is a second view describing the configuration of the above conveyance guiding member and sheet feeding cassette.

Meanwhile, in the present embodiment, the abutting portion 50*a* of the conveyance guiding member 50 is formed in an entire movable range of the side regulating members 71 in the width direction as illustrated in FIG. 3. By this means, irrespectively of the positions of the side regulating members 71, that is, irrespectively of the size of a sheet, when the sheet feeding cassette 70 is attached, the supporting portions 71*a* of the side regulating members 71 can abut on the abutting portion 50*a* of the conveyance guiding member 50.

In addition, when the sheet feeding cassette 70 is detached from the printer body 101, and the sheet feeding cassette 70 is drawn a predetermined distance, the conveyance guiding member 50 and the side regulating members 71 do not contact each other. Therefore, it is possible to reduce a load upon removal of the sheet feeding cassette 70. Further, when the sheet feeding cassette 70 is attached to the printer body 101, the conveyance guiding member 50 and the side regulating members 71 do not contact each other until the sheet feeding cassette 70 is pushed in a predetermined distance. Therefore, it is possible to reduce a load upon attachment of the sheet feeding cassette 70.

As described above, as in the present embodiment, when the sheet feeding cassette 70 is attached to the printer body 101, the conveyance guiding member 50 is supported by the side regulating members 71. Therefore, it is possible to prevent deformation of the conveyance guiding member 50. As a result, it is possible to stably convey a sheet without reinforcing the conveyance guiding member 50.

In addition, in the present embodiment, when the sheet feeding cassette 70 is attached, the side regulating members 71 abut on the conveyance guiding member 50 to have the side regulating members 71 support the conveyance guiding member 50. However, the side regulating members 71 may not abut on the conveyance guiding member 50 when the sheet feeding cassette is attached, and, when the conveyance guiding member 50 deflects downward in an elastic range, that is, when the conveyance guiding member 50 deforms downward a predetermined amount, the conveyance guiding member 50 may abut on the side regulating members 71. In case of this configuration, it is possible to further reduce a load upon attachment and detachment of the sheet feeding cassette 70. Further, the conveyance guiding member 50 can be supported in this case without providing the supporting portions 71*a* to project from the side regulating members 71.

Incidentally, although, as described above, the abutting portion 50*a* of the conveyance guiding member 50 is provided over the entire movable range of the side regulating members 71 in the conveyance guiding member 50 as illustrated in FIG. 3, the present invention is by no means limited to this. If, for example, the conveyance guiding member 50 is likely to deform upon product shipping, the abutting portion 50*a* may be provided in a center portion of the conveyance guiding member 50 in the width direction as illustrated in FIGS. 4A and 4B.

Figure 4A:
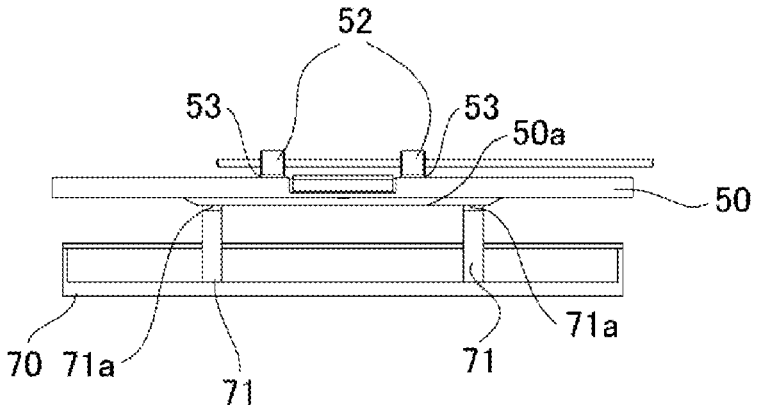
FIGS. 4A and 4B are views describing another configuration of the conveyance guiding member.
Figure 4B:
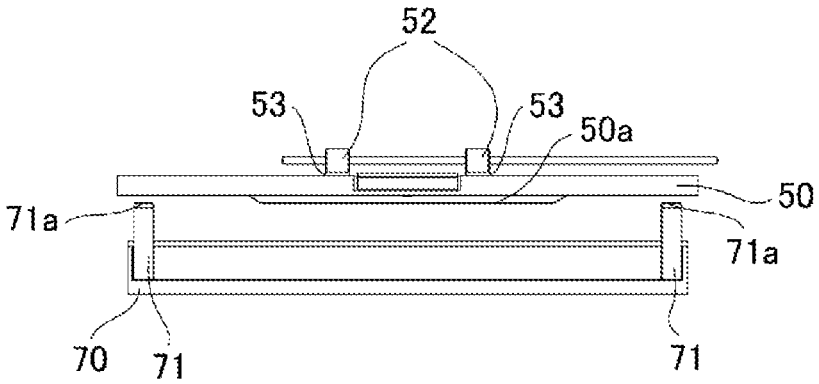

Further, by moving the side regulating members 71 toward the center of the width direction as illustrated in FIG. 4A upon product shipping and shipping a product in a state where the supporting portions 71*a* and the abutting portion 50*a* abut on each other, it is possible to prevent deformation of the conveyance guiding member 50 upon product shipping. In addition, when a user uses a sheet of a general-purpose size, the conveyance guiding member 50 and the side regulating members 71 do not abut on each other as illustrated in FIG. 4B, so that the sheet feeding cassette 70 is easily attached and detached. Thus, when the abutting portion 50*a* is provided in the center portion of the conveyance guiding member 50 in the width direction, it is possible to prevent deformation of the conveyance guiding member 50 without losing a sense of an operation of attaching and detaching to and from the sheet feeding cassette 70.

Figure 5A:
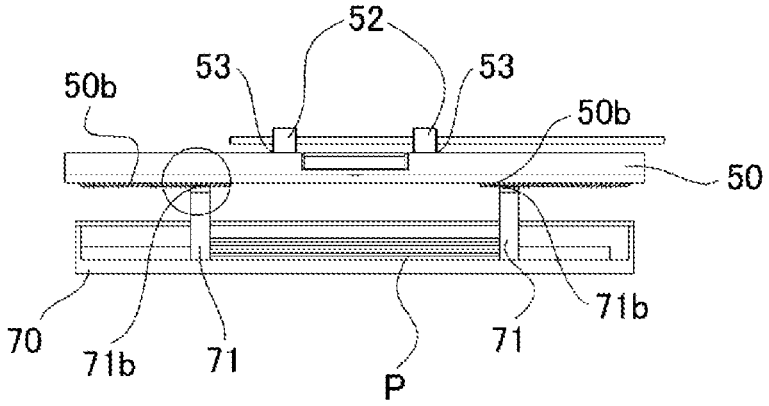
FIGS. 5A and 5B are views describing a configuration of a conveyance guiding member and a sheet feeding cassette provided to an image forming apparatus according to a second embodiment of the present invention.
Figure 5B:
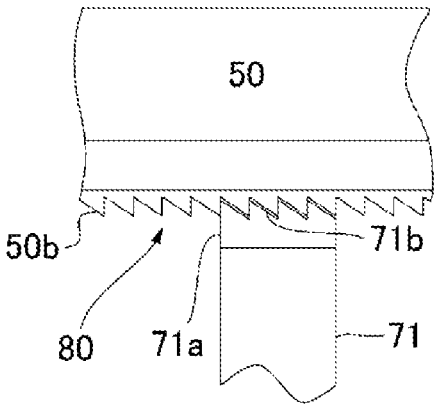

Next, a second embodiment of the present invention will be described. FIGS. 5A and 5B are views illustrating a configuration of an image forming apparatus according to the present embodiment. In addition, the same reference numerals in FIGS. 5A and 5B as those in FIG. 3 indicate the same or corresponding portions.

In FIG. 5A, target position regulating portions 71*b* are latched portions which are formed on the upper surfaces of supporting portions 71*a* of side regulating members 71 and which have tooth shapes. Further, position regulating portions 50*b* are latching portions which are provided at both end portions of the bottom surface of an abutting portion 50*a* of a conveyance guiding member 50 in the width direction, and which have a tooth-shape. Furthermore, when a sheet feeding cassette 70 is attached to a printer body 101, the target position regulating portions 71*b* of the side regulating members 71 latch onto the position regulating portions 50*b* of the conveyance guiding member 50 as illustrated in FIG. 5B. By this means, it is possible to regulate movement of the side regulating members 71 in the width direction.

Thus, when the sheet feeding cassette 70 is attached to the printer body 101, it is possible to prevent skew feeding of a sheet caused by unintentional movement of the side regulating members 71 upon feeding of a sheet by regulating movement of the side regulating members 71. By this means, it is possible to prevent deformation of the conveyance guiding member 50, and more stably convey the sheet.

In addition, although an example has been described with the present embodiment where the present invention is applied to a conveying guide which guides a manually fed sheet arranged above the sheet feeding cassette 70, the present invention is by no means limited to this. The present invention is also applicable to a configuration in which a re-conveying path which conveys a sheet on one surface of which an image is formed to an image forming portion again is arranged above the sheet feeding cassette to form an image on both surfaces of the sheet.

Further, although, in the present embodiment, a movement regulating portion 80 which regulates movement of the side regulating members 71 in the width direction when the sheet feeding cassette 70 is attached is formed with the position regulating portions 50*b* which have tooth shapes and the target position regulating portions 71*b*, the present invention is not limited to this.

Figure 6A:
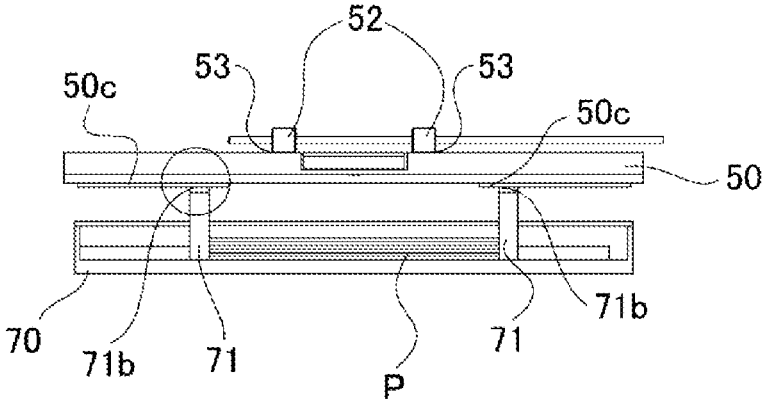
FIGS. 6A and 6B are views describing another configuration of the above conveyance guiding member and sheet feeding cassette.
Figure 6B:
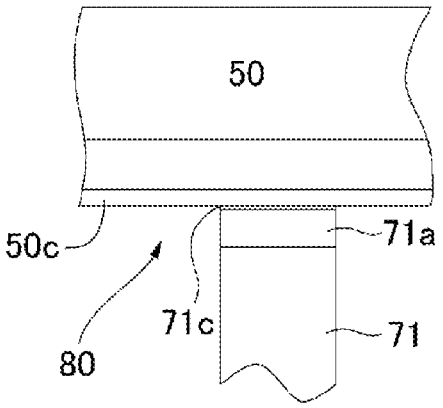

For example, at least one side of the position regulating portions 50*b* and the target position regulating portions 71*b* may be formed by a friction member. In addition, FIGS. 6A and 6B illustrate examples where the position regulating portions 50*c* and the target position regulating portions 71*c* are formed with friction members such as rubber, sponge or cork.

Further, although a configuration has been described with the present embodiment where a manually fed sheet P1 is inserted one by one in an opening portion 105 provided on one side surface of the printer body 101, the present invention is by no means limited to this. For example, a configuration may be employed where a manual feed tray and a separating/feeding mechanism are provided on one side surface of the printer body 101, a user loads a plurality of sheets to the manual feed tray and the separating/feeding mechanism separates a sheet from the top of the tray and feeds the sheet.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-037543, filed Feb. 23, 2012, which is hereby incorporated by reference herein in its entirety.

What is claimed is:

1. A sheet stacking apparatus comprising:

a sheet stacking member on which sheets are stacked, the sheet stacking member being detachably attached to an apparatus body;

a conveyance guide provided in the apparatus body, the conveyance guide positioned above the sheet stacking member when the sheet stacking member is attached to the apparatus body;

a regulating member movably provided to regulate a position of the sheets stacked on the sheet stacking member;

an abutted portion provided on a bottom surface of the conveyance guide;

an abutting portion provided so as to move integrally with the regulating member, the abutting portion abutting a bottom surface of the abutted portion; and a movement regulating portion which regulates movement of the regulating member in a moving direction of the regulating member when the sheet stacking member is attached to the apparatus body, wherein the abutting portion is movable between a first position in which the abutting portion abuts the abutted portion in a state that the sheet stacking member is attached to the apparatus body and a second position in which the abutting portion has moved integrally with the regulating member in the regulating member's movable direction from the first position so that the abutting portion does not abut the abutted portion in the state that the sheet stacking member is attached to the apparatus body, wherein the movement regulating portion includes a latching portion provided in the conveyance guide and a latched portion formed on an upper surface of the abutting portion.

2. The sheet stacking apparatus according to claim 1, further comprising a movement regulating portion which regulates movement of the regulating member in a moving direction of the regulating member when the sheet stacking member is attached to the apparatus body.

3. The sheet stacking apparatus according to claim 2, wherein the movement regulating portion includes a friction member.

4. The sheet stacking apparatus according to claim 1, wherein the conveyance guide guides the sheet fed one by one from an opening portion provided on one side surface of the apparatus body.

5. The sheet stacking apparatus according to claim 1, wherein the regulating member is provided movably in a direction orthogonal to a direction in which the sheet stacking member is attached to the apparatus body.

6. The sheet stacking apparatus according to claim 5, wherein the regulating member has a pair of side regulating members.

7. The sheet stacking apparatus according to claim 5, wherein the abutted portion is provided at center in a direction orthogonal to a direction in which the sheet stacking member is attached to the apparatus body and is provided to project from the conveyance guide so as to be lower than another portion of the conveyance guide.

8. The sheet stacking apparatus according to claim 1, wherein in a direction in which the abutting portion moves integrally with the regulating member, the abutted portion provided at a position corresponds to a position of the abutting portion located at the first position.

9. The sheet stacking apparatus according to claim 1, wherein the abutting portion is provided on a upper surface of the regulating member.

10. The sheet stacking apparatus according to claim 1, wherein the abutting portion is located at the first position upon product shipping.

11. The sheet stacking apparatus according to claim 1, wherein the second position is provided at a position corresponding to a position in which the regulating member regulates a sheet of a general-purpose size.

12. The sheet stacking apparatus according to claim 1, wherein the conveyance guide guides a sheet manually inserted into an opening portion provided on a side surface of the apparatus body.

13. A sheet stacking apparatus comprising;

a sheet stacking member on which sheets are stacked, the sheet stacking member being detachably attached to an apparatus body;

a conveyance guide provided in the apparatus body, the conveyance guide positioned above the sheet stacking member when the sheet stacking member is attached to the apparatus body;

a regulating member movably provided to regulate a position of the sheets stacked on the sheet stacking member;

an abutted portion provided on a bottom surface of the conveyance guide;

an abutting portion provided so as to move integrally with the regulating member, the abutting portion abuts on a bottom surface of the abutting portion, and which can move between a first position in which the abutting portion abuts on the abutted portion in a state that the sheet stacking member is attached to the apparatus body and a second position where the abutting portion has moved integrally with the regulating member in the regulating member's movable direction from the first position, the second position being a position in which the abutting portion does not abut on the abutted portion in the state that the sheet stacking member is attached to the apparatus body; and a pair of rollers, the pair of rollers including a drive roller provided on the apparatus body and a conveying roller provided rotatably on the conveyance guide which presses against the drive roller.

14. A sheet stacking apparatus comprising;

a sheet stacking member on which sheets are stacked, the sheet stacking member is detachably attached to an apparatus body;

a conveyance guide provided in the apparatus body, the conveyance guide is positioned above the sheet stacking member when the sheet stacking member is attached to the apparatus body;

a regulating member provided movably to regulate a position of the sheet stacked on the sheet stacking member; and an abutted portion provided on a bottom surface of the conveyance guide;

an abutting portion provided so as to move with the regulating member integrally, the abutting portion abuts on a bottom surface of the abutting portion, herein the abutting portion can move between a first position in which the abutting portion abuts on the abutted portion in a state that the sheet stacking member is attached to the apparatus body so as that the conveying guide deflects downward and a second position where the abutting portion does not abut on the abutted portion in a state that the sheet stacking member is attached to the apparatus body even so as that the conveying guide deflects downward.

* * * * *